United States Patent [19]

Yuen

[11] Patent Number: 4,948,365

[45] Date of Patent: Aug. 14, 1990

[54] HIGH-TEMPERATURE, GAS-BURNING FURNACE

[75] Inventor: Walter W. Yuen, Santa Barbara, Calif.

[73] Assignee: Zond Systems, Inc., Techachapi, Calif.

[21] Appl. No.: 357,371

[22] Filed: May 24, 1989

[51] Int. Cl.[5] ..... F27B 7/08

[52] U.S. Cl. ..... 432/103; 432/112; 432/113

[58] Field of Search ..... 432/103, 105, 107, 112–114

[56] References Cited

U.S. PATENT DOCUMENTS

| | | | |
|---|---|---|---|
| 1,064,263 | 6/1913 | Wallos | 432/112 |
| 2,348,673 | 5/1944 | Degner | 432/113 |
| 3,097,833 | 7/1963 | Harris et al. | 432/113 |
| 3,441,259 | 4/1969 | Heyer et al. | 432/113 |
| 4,191,530 | 3/1980 | Beance | 432/113 |
| 4,451,231 | 5/1984 | Murray | 432/112 |
| 4,782,768 | 11/1988 | Lee et al. | 432/103 |
| 4,836,862 | 6/1989 | Pelka et al. . | |

*Primary Examiner*—Henry C. Yuen

*Attorney, Agent, or Firm*—William W. Haefliger

[57] ABSTRACT

A novel high-temperature, gas-burning furnace has a rotating porous-ceramic bed, which serves the integral functions of wall insulator, thermal regenerator, combustion chamber, and radiant heater. The configuration permits high chamber temperatures (up to 1400° C.), large temperature gradients across the bed (typically, 600° C. across 2.5 cm), and low stack losses (exhaust stream on the order of 250° C.).

12 Claims, 15 Drawing Sheets

HIGH-TEMPERATURE, GAS-BURNING FURNACE

BACKGROUND OF THE INVENTION

There is need for highly efficient, regenerator-type furnaces of rotary configuration providing low-cost, efficient, high-temperature heating. It has been found that when a regenerator consisted of a loose particle bed held in solid body rotation, as in a cylinder shape, two problems resulted. Firstly, the bed porosity was quite low, for example around 40%, and the small particles of 2 mm mean diameter that were employed were very tightly packed. This offered undesirably great resistance to air flow. Secondly, the rotation rate superimposed a high tangential velocity on the incoming air which resulted in "fanning" it directly to the outlet, depriving the combustion chamber within the cylinder of oxidant. Under these circumstances, only a small flame could be maintained, but for only very small bed thickness, e.g., less than 5 mm—a thickness negligible as far as any regenerative effect was concerned. Thus, enhanced regenerative effect was not possible.

SUMMARY OF THE INVENTION

It is a major object of the invention to provide a greatly improved regenerative-type furnace, creating the above need, and overcoming the above described disadvantages. This objective is realized by the invention through the provision of furnace apparatus comprising:

(a) rotor, and means to rotate the rotor, (b) a substantially cylindrical, porous ceramic bed carried by the rotor, the bed having an axis of rotation, the bed surrounding a combustion zone, (c) a housing into which the rotor and be are received, and having an inlet for air to pass through the rotating bed to be preheated and then to pass into the interior zone, (d) fuel inlet means for supplying fuel to the combustion zone to mix with air therein for combustion in the zone, (e) and the housing having an outlet to discharge hot combustion products which have passed through the porous bed to pre-heat same, (f) the bed thickness predetermined to provide regeneration, at over 1,000° C.

As will be seen, the bed typically consists of porous, non-metallic material which is cylindrically unitary, i.e., not in particulate form, and may for example consist of one of the following: alumina, and alumina/zirconia composite. Such a porous bed may be carried adjacent the inner side of a rotor perforate metallic (for example stainless steel) wall which is cylindrical and rotates about the bed and rotor axis, the annular bed having substantially uniform thickness.

It is another object of the invention to provide sealing means sealing off between the bed and the interior of the housing, the means providing porting for flow of air into the bed, and for flow of combustion products from the bed, the porting located at opposite sides of the axis. The sealing means typically includes annular end seals, at opposite ends of the bed, whereby hot gases cannot escape into the housing interior, but are constrained to flow from an inlet through the porous bed into the furnace interior, and then again through the porous bed to an outlet. Typically, the bed has between 40% and 90% porosity, i.e., open space within the body of the unitary bed material.

These and other objects and advantages of the invention, as well as the details of an illustrative embodiment, will be more fully understood from the following specification and drawings, in which:

DRAWING DESCRIPTION

Figure 8:
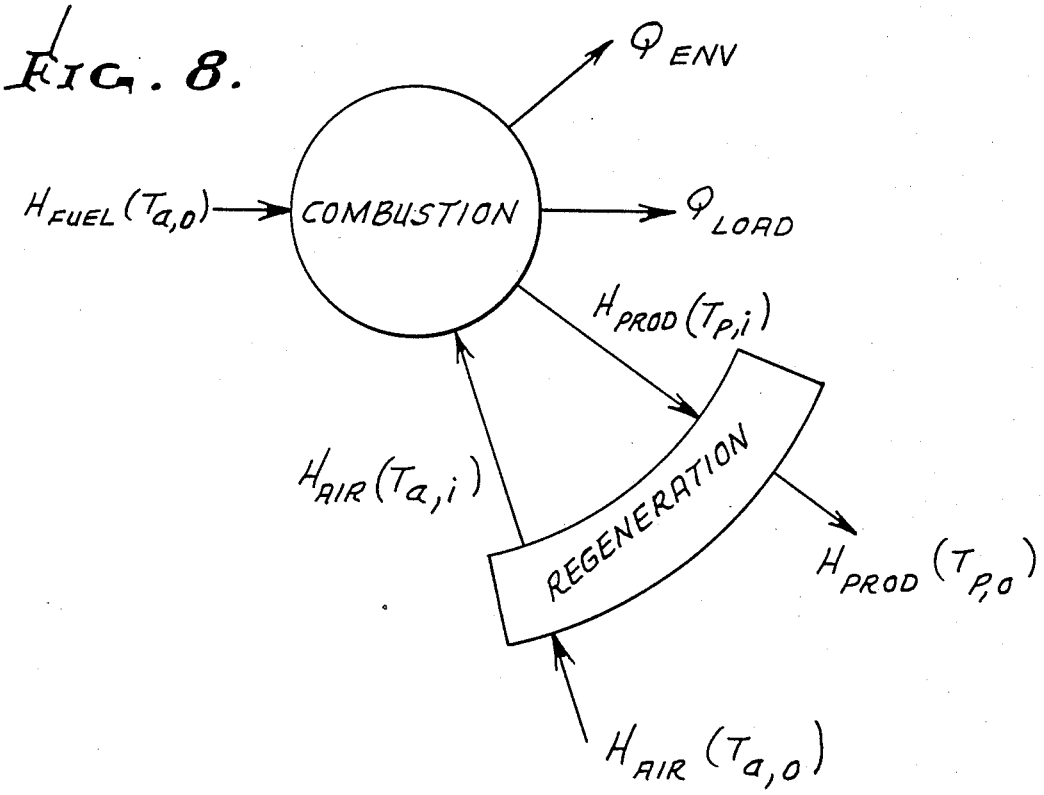

FIGS. 6A, 6B, 6C, 7A, 7B, 7C, and 7D are graphs;

FIG. 8 is a furnace energy flow diagram; and

FIGS. 9, 10, 11A, 11B, 11C, 12A, 12B, 12C, 12D, 13, 14, 15, 16A, 16B, and 17 are graphs.

DETAILED CONSTRUCTION

Figure 1:
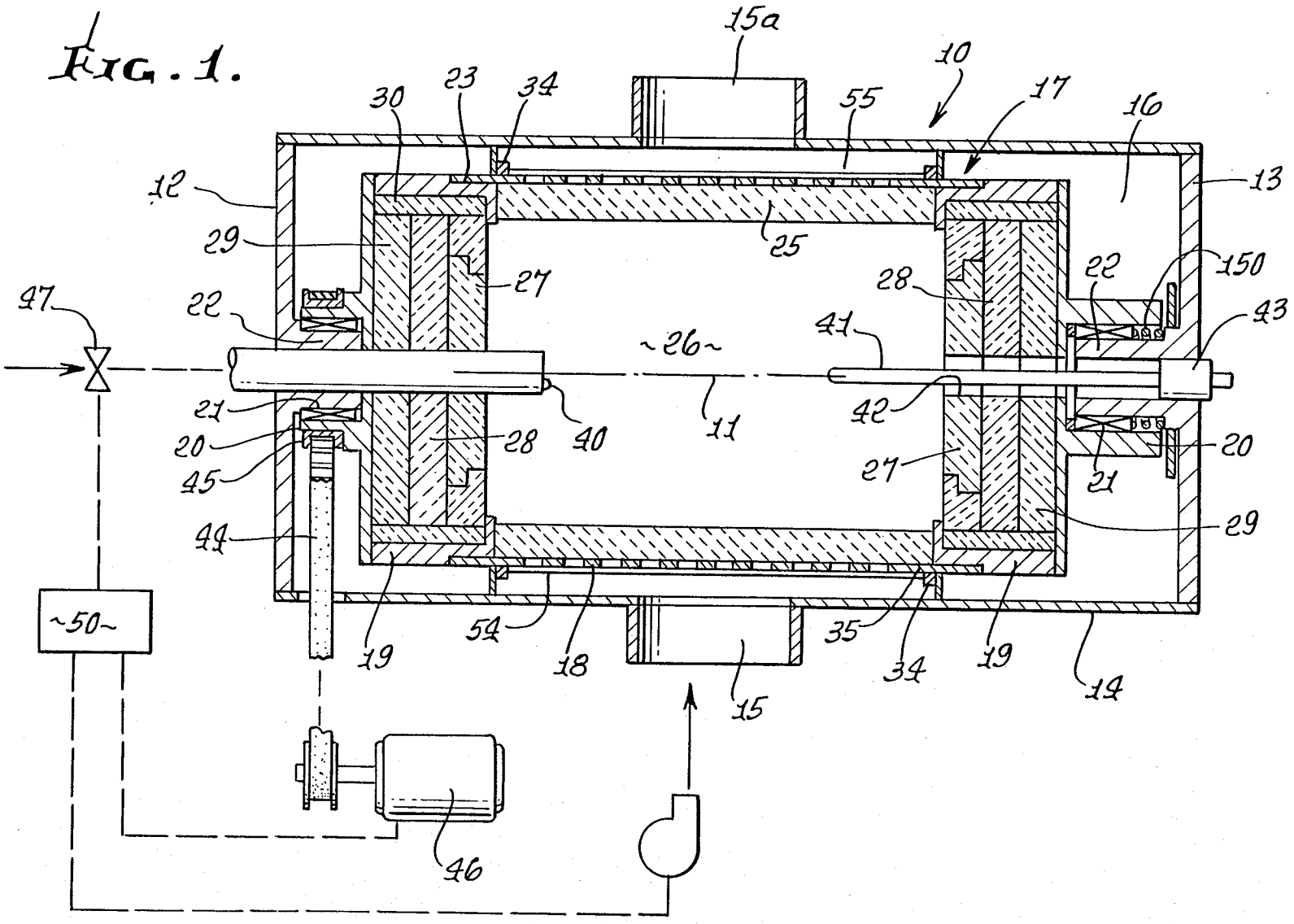
FIG. 1 is an axial section taken through a furnace embodying the invention.

In FIG. 1, a housing 10 is elongated in the direction of axis 11, and has end walls 12 and 13, a wall 14 extending between 12 and 13 and about axis 11, a lower inlet 15 in wall 14, and an upper outlet **15*a* in wall 14, i.e., above the inlet. Mounted for rotation within the interior 16 of the housing, and about axis 11, is a rotor 17. The latter includes a perforated cylindrical, metallic, as for example stainless steel wall or shell 18, bridging the inlet and outlet. The shell is supported at its opposite ends by metallic cups 19 having integral end sleeves 20 supported on bearings 21. The latter are carried by the stub axles 22 integral with housing end walls 12 and 13. The shell 18 is attached to the cups, as at 23**.

A substantially cylindrical or annular, porous ceramic bed 25 is carried by the rotor, as at the inner side of the perforate shell 18, the bed being co-axial with the shell and surrounding an interior combustion zone 26. Opposite ends of the bed are closed by means such as thermal insulation layers 27, 28, and 29, these being surrounded by annular thermal insulation layer 30, and received in the cups.

Also shown are annular end seals 34, as for example of Teflon, sealing off between the rotating rotor and the non-rotating metallic housing. Such seals may be annuli of Teflon, sealingly engaging the housing annular side 35, and carried by the outer surface of the rotor shell. A fuel gas inlet nozzle 40 extends axially endwise into the rotor and into the combustion zone, as shown. A temperature sensing probe 41 extends into the opposite end of the rotor, via a bore 42, sealed off at 43. A motor driven timing belt 44 engages a pulley 45 on an end sleeve 20. Controls to control the timing belt drive motor 46, a valve 47 that admits fuel gas to nozzles, and a blower 48 to blow air through the furnace, appears at 50.

In one example, the rotor overall length and diameter are, respectively, 0.6 and 0.3 meters. The rotor turns at eight RPM on carbon-graphite bushings. Fuel gas is injected into the furnace end and it mixes with air which has been preheated by the rotating porous bed. Combustion products exit the inner chamber through an opposite section of the bed. The seals are made of Teflon since the outer rotor temperature is expected to stay below 260° C. Temperatures are monitored throughout the furnace with type K thermocouples, and a high-temperature thermocouple probe surveys the combustion chamber temperature. This compact design results in high chamber temperatures (up to 1400° C.), large temperature gradients across the bed (typically, 600° C. across 2.5 cm), and low stack losses (exhaust stream temperature is on the order of 250° C.).

The rotor holds the porous regenerative bed and the combustion chamber within it. It consists of a perforated stainless steel shell with carbon steel ends. It holds high-temperature, end-insulation layers; graphite bushings; and interior space to add a porous matrix. The porous matrix of 0.3 m length and 0.245 m outer diameter can have thicknesses ranging up to 0.085 m. The insulation thickness selected for each rotor end is 7.6 cm (3 in.).

The rotor is located axially by a spring 150 whose tension can be varied by the operator. It is free to move axially and radially with temperature expansion. This design, which combined with an inner insulation layer and an inner porous bed layer of zirconia, will withstand chamber temperatures up to 2000° C. Rotation can be varied between 6 to 600 RPM.

Seals 54 and 55 (see FIG. 2) are intended to channel incoming cold air via inlet 56 through the rotor and its porous bed to the combustion chamber. After combustion, they channel the exhaust stream via outlet 57 to the exhaust plenum. They otherwise keep combustion gases from escaping the inner combustion chamber zone.

Figure 2:
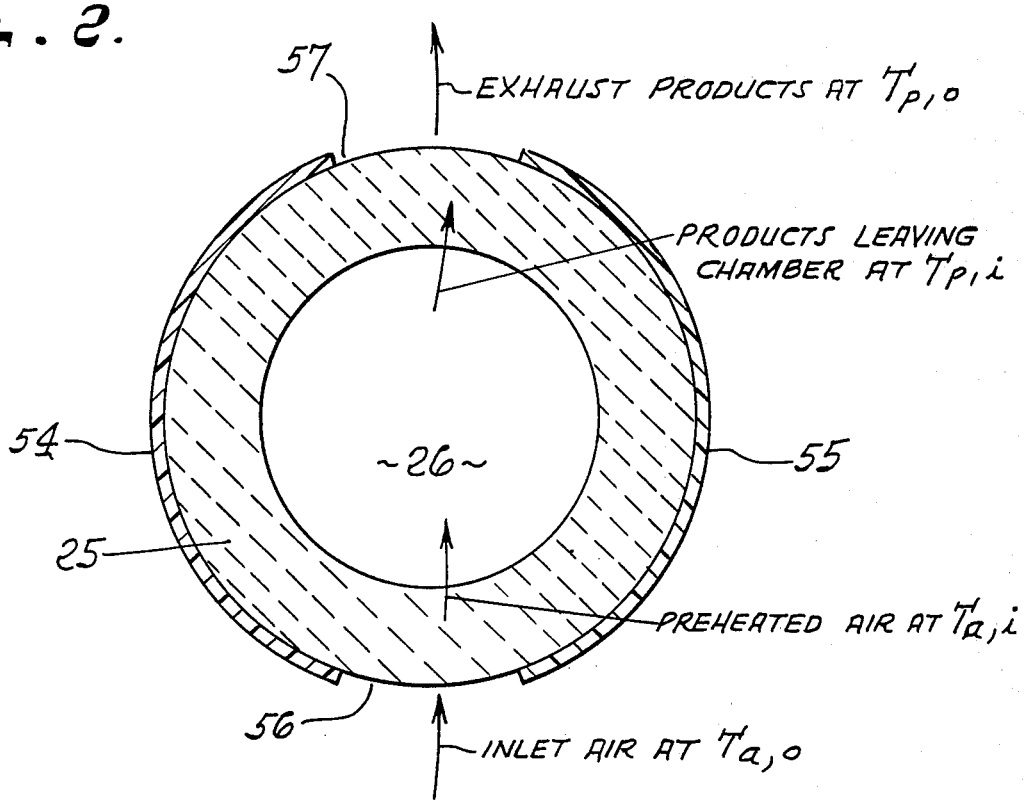
FIG. 2 is a schematic diagram taken through a bed normal to its cylindrical axis, to illustrate operation.

To accomplish the above, two sets of dynamic seals are employed:

(1) radial: these are four ¼ inch (0.64 cm) interheaved graphite packings which are flexibly tensioned by springs to accommodate rotor eccentricity and thermal expansion (FIG. 1);

(2) axial: these consist of two Teflon sheets 54 and 55 which fit the outside of the rotor along its length and for an arc span as desired. These sheets are also held in such a way as to accommodate rotor eccentricity and expansion. They slide against an area of the rotor which is perforated (FIG. 2).

The seals are kept in the colder area of the rotor, its outer diameter surface, allowing for an economic design and the use of Teflon composites with their flexibility and desirable properties.

Natural gas or methane are introduced into the combustion chamber through the front end of the furnace, concentric to the bushing, the housing faceplate, and the rotor faceplate as shown in FIG. 1. This is accomplished with a 2.54 cm diameter tube assembly. The tube serves the dual function of supplying the gas fuel for combustion, and supplying a thermal load to the furnace by flowing water through it. Temperature in the proximity of the nozzles is monitored with a thermocouple.

The gas is turned on and the flame is ignited with the tube in air; it is then introduced through the access hole into the furnace chamber. With a small amount of inlet air flow to balance the inside/outside pressures, the flame does not blow out on introduction into the chamber.

FIG. 2 illustrates the operation of the furnace. The rotating porous bed transfers heat from the hot exhaust products leaving the rotor through the top at 57, to the cold incoming air, entering the rotor at the bottom, at 56.

EXAMPLE

For each run, data was gathered by measuring fluid flow rates and measuring temperatures. The present discussion has to do with the development of a correction to the chamber temperatures.

Air and gas flow rates were measured with calibrated rotameters. Cooling water flow rate was measured with a timer/volume setup. Temperatures were monitored throughout the furnace. Type K uncalibrated thermocouples, i.e., as delivered from the manufacturer, were used throughout. The thermocouples were connected to an isothermal TC switch box and from there to a calibrated self-compensating digital thermometer. A type B thermocouple was used to measure the chamber temperatures for runs in which the temperatures exceeded 1200° C.

Of importance to thermodynamic calculations are the inlet temperatures of the cooling water, fuel gas, and inlet air. These were taken to be constant for each and all tests. The water outlet temperature, $T_{wo}$, the exhaust gas temperature, $T_x$, and a set of local furnace chamber temperatures, $T_i$, were taken for each run. To arrive an experimental rotor convective heat transfer coefficient, a set of outer rotor temperatures were taken for many runs.

Installation errors due to radiation on the exhaust thermocouple junction were reduced to a negligible amount by using an exposed junction surrounded by two shields protecting it from "seeing" the colder duct. Some experiments were run comparing the situations of no-shield, one-shield, and two-shield, before it was concluded that two shields would give a negligible radiative loss. The conduction loss was eliminated by placing the thermocouple wire along a flow streamline for a certain distance.

The situation for the combustion chamber temperature was substantially more complicated. As is well known [4], measuring flame temperatures is surrounded by uncertainties. We are interested in obtaining from the experiment a mixed chamber temperature $T_c$ which can be compared to its equivalent $T_{p,i}$ as generated by the theoretical model. We obtained this mixed chamber temperature by first sampling the center of the combustion chamber at n locations with a thermocouple probe. A mean uncorrected chamber temperature was found as $$T_j = \frac{1}{n} \sum_{i=1}^{n} T_i \tag{1}$$

By only taking temperature readings at points sufficiently far away from each rotor-end inner wall, the heat exchange at the junction consists of only the convective heat transfer from the combustion gas and the radiative heat transfer to the chamber walls. An energy balance at the junction can thus be written as $$h_c(T_c - T_j) = \epsilon\sigma(T_j^4 - T_w^4) \tag{2}$$

where $h_c$ is the convective heat transfer coefficient between the junction and the combustion gas, and $\epsilon$ is the emissivity of the junction.

The difficulty behind this estimate of the chamber temperature lies in estimating the different parameters and variables, all of which have to be derived or calculated indirectly except for $T_j$, the measured equilibrium junction temperature. Our strategy is to arrive at reasonable ranges for these unknowns and develop uncertainty bounds for the corrected mixed chamber temperature, $T_c$.

Before we develop a convective heat transfer coefficient, we need to understand the nature of the flow inside the furnace. The local velocity field is the result of several phenomena:

(1) transverse methane round jets;

(2) air flow up;

(3) density gradients (buoyancy due to combustion and density difference between methane and air.

The air flowing through the chamber is expected to be in a laminar regime due to the large flow area and slow flow velocities for the operating range of interest. This was visually observed to be the case. On the other hand, gas emerging from the nozzles can be either laminar or turbulent depending o the flow rate. At low fuel flow rates, the flame is laminar and attached to the burner. But as the flow rate is increased, a transition region is reached in which the flow changes from laminar to turbulent and a flame brush "lifts-off" the burner, resulting in high turbulence and a noisy flame. Thus the fuel flow rate has a dominant effect as far as heat transfer to the thermocouple probe is concerned.

Figure 5:
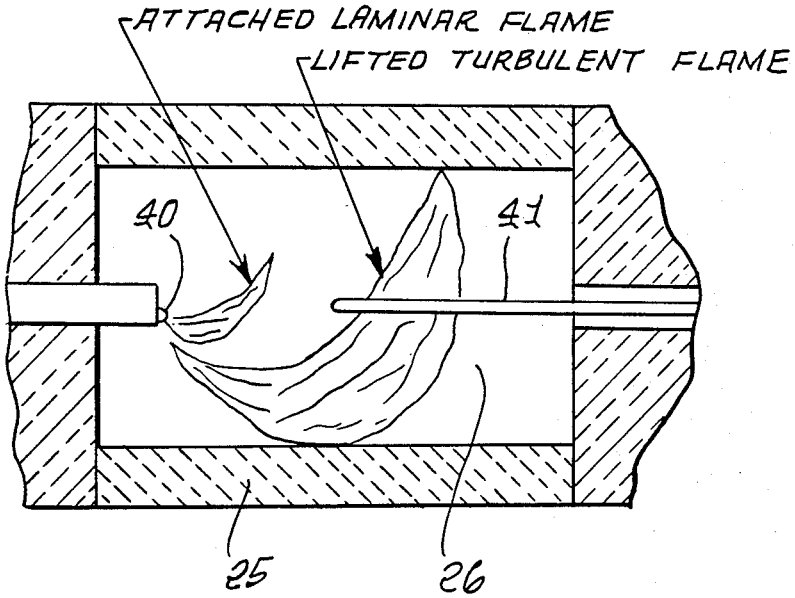
FIG. 5 is a schematic diagram taken axially through a bed, to illustrate laminar and turbulent flame formation.

The burner under consideration consisted of four orifices of 0.64 mm (25 thousands) diameter. They aimed down at about 45° to counteract the effect of buoyancy which would carry the flame well into the porous bed disrupting its regenerative function. As the gas flow rate increased above $3.3\times10^{-5}m^3/s$ (0.07 cfm), the flame would liftoff. For all runs, the flame burned turbulent and noisy. The expected shape and location of both a laminar and a turbulent flame inside the chamber is presented in FIG. 5.

Figure 6A:
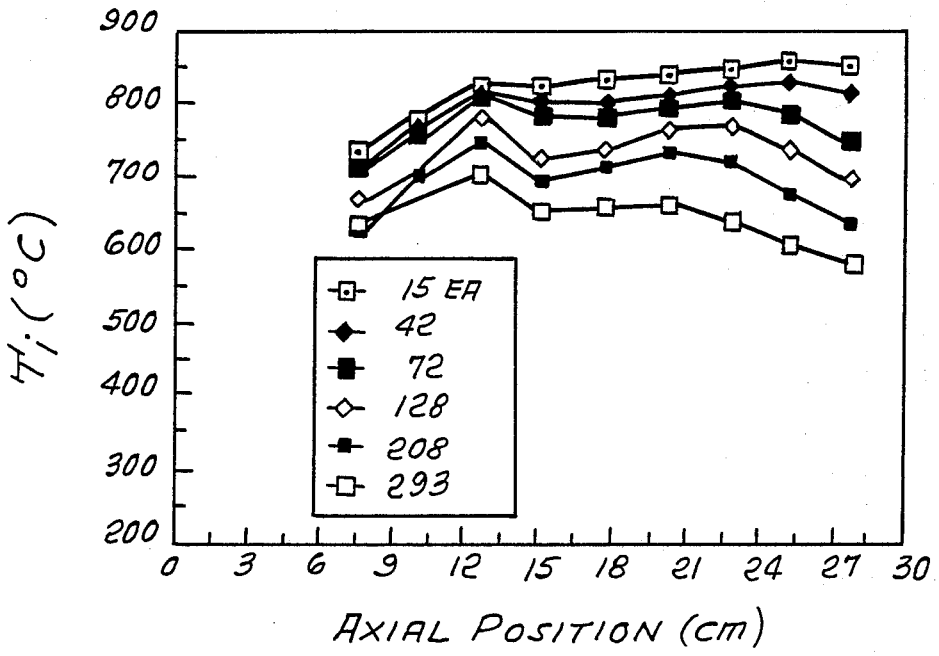
Figure 6B:
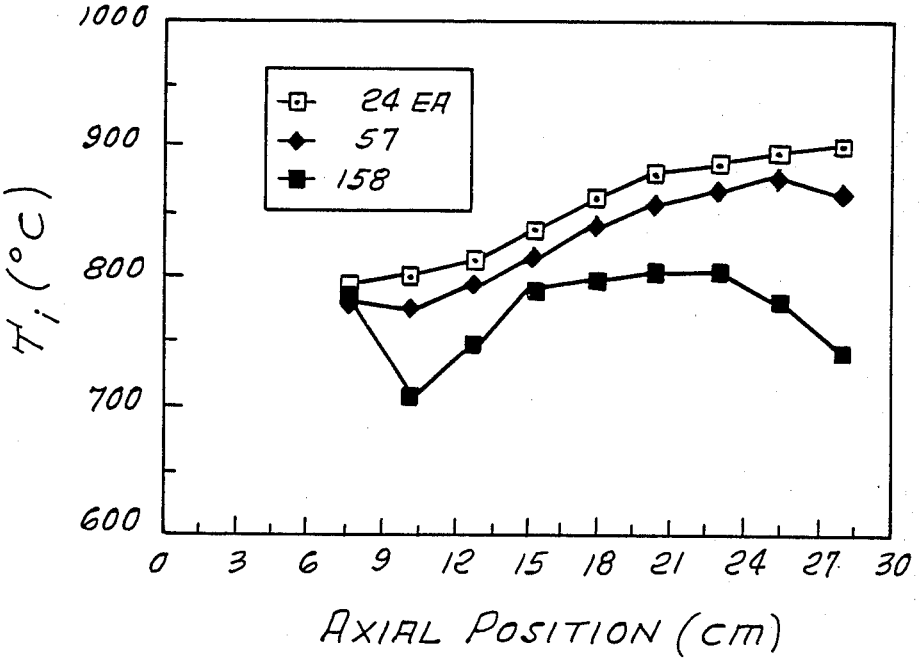
Figure 6C:
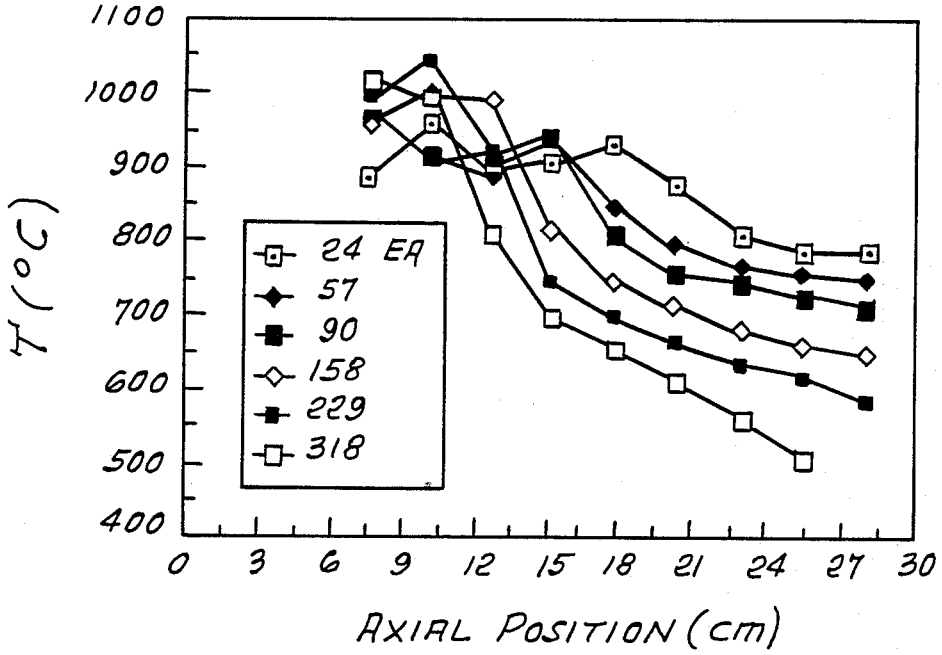
Figure 7A:
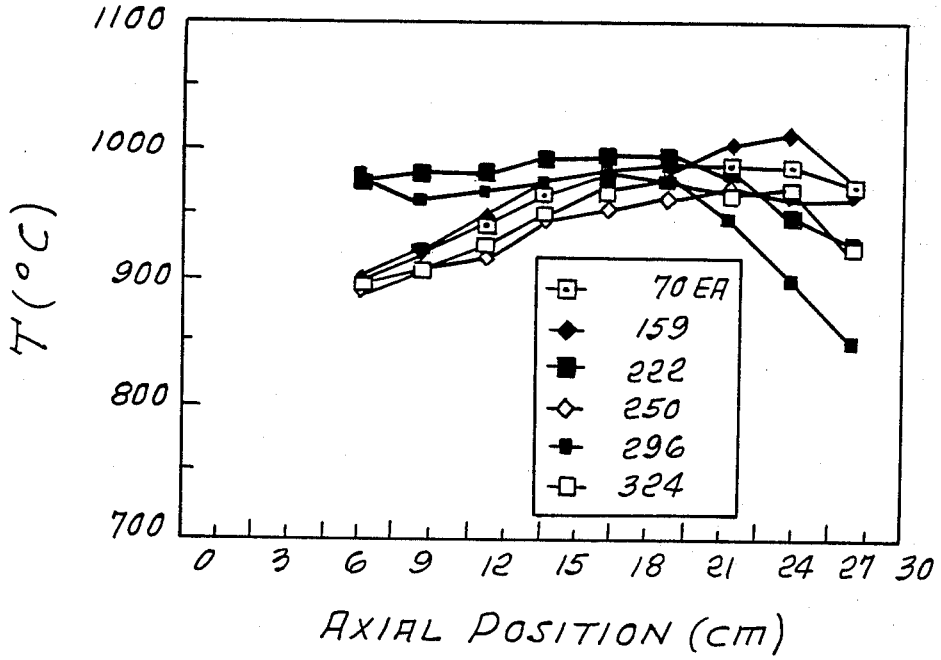
Figure 7B:
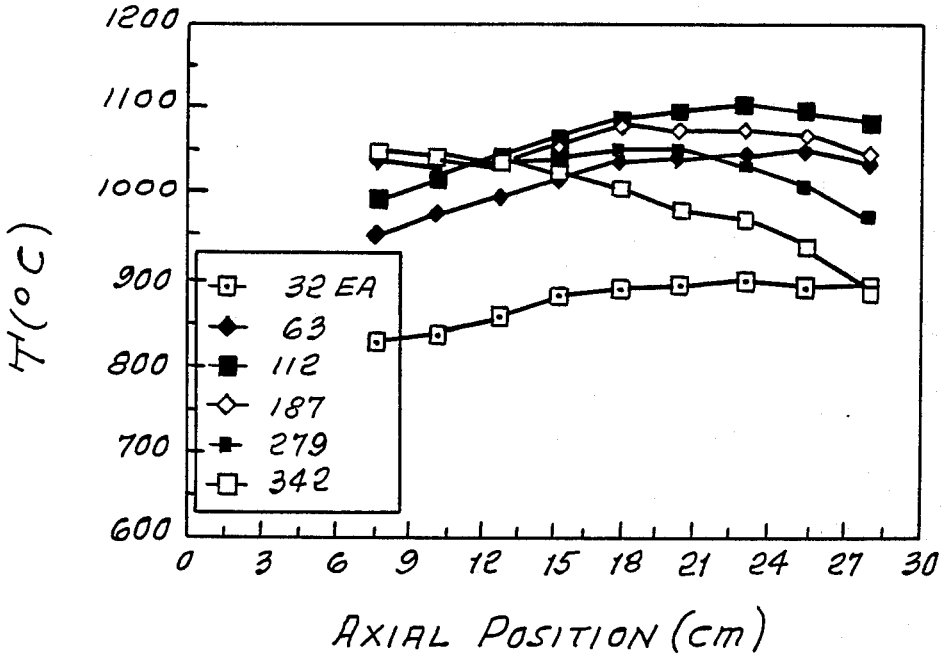
Figure 7C:
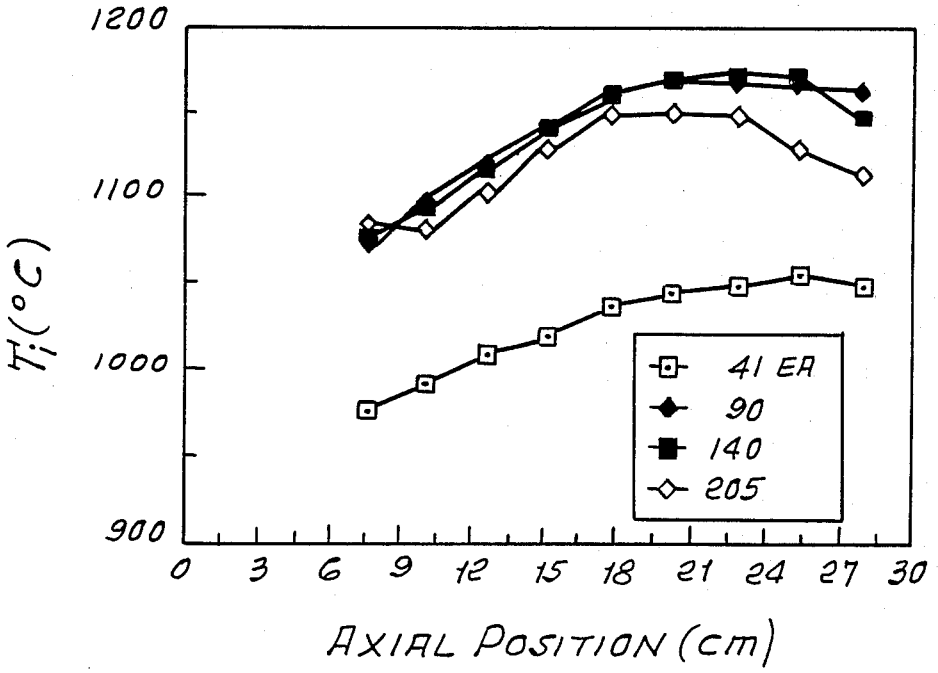
Figure 7D:
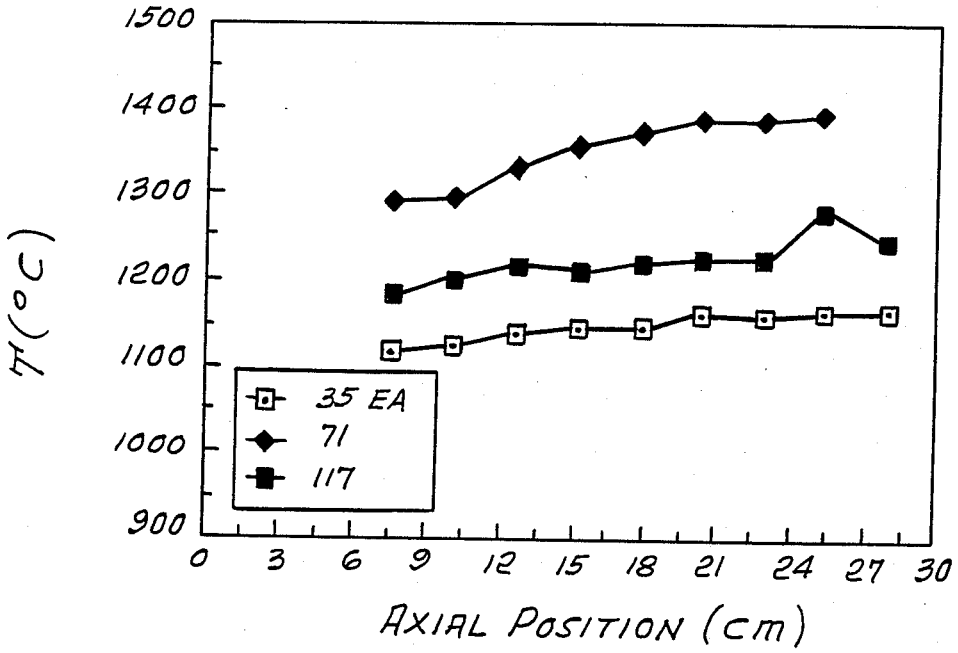

FIGS. 6A and 6B present uncorrected chamber temperature profiles for two different fuel flow rates and various excess air. It can be readily observed that in all cases, the flame penetrates a long distance away from the burner. The relatively uniform temperature distribution also suggests that the combustion is turbulent and good mixing occurs inside the combustion chamber. FIG. 6C shows the uncorrected chamber temperature profiles for a burner with six orifices. For the same fuel flow rate as data presented in FIG. 6B, the fuel injection velocity is slower. As indicated by the temperature data, the flame appears to be laminar and concentrated near the region of the injector. For high and uniform combustion chamber temperature, it is apparent that turbulent flames are required. A burner with four orifices is used to generate all of the remaining data reported in this work. FIGS. 7A, 7B, 7C, and 7D present chamber temperature profiles for 5.1 cm thick bed.

To estimate the heat transfer coefficient between the junction and the combustion gas, a heat transfer correlation developed by Moffat [5] is utilized. The instantaneous flow direction of the gases surrounding the thermocouple can vary greatly from normal to parallel to its axis (Moffat gives correlations for both), and turbulence can significantly enhance heat transfer. Moffat's correlation giving higher heat transfer is thus utilized:

$$Nu=(0.44\pm0.06)Re^{\frac{1}{2}} \quad (3)$$

In the above expression, both the Nusselt number ($Nu=h_cd/k$) and the Reynolds number ($Re=U_md/V$) are defined based on the diameter of the ceramic tube surrounding the high temperature thermocouple (d) and properties of the combustion gas (thermal conductivity, k and kinematic viscosity, v). The average velocity $U_m$ is calculated according to correlations given for the length of a methane diffusion flame [6] and to the mean velocity of that flame [7]. This velocity is typically an order of magnitude greater than the inlet air velocity in our case.

As indicated in equation (2), the junction's equilibrium temperature is a strong function of $T_w$, the average wall temperature, since the energy exchange between the two is proportional to the fourth power of these temperatures. The wall temperature, however, is practically impossible to measure due to the rotation of the bed. An upper and lower bound of this temperature is determined based on thermal considerations.

Specifically, since the wall is heated primarily by the combustion products, the wall temperature is limited thermodynamically to be less than the highest uncorrected junction temperature, $T_{i,max}$, which should correspond approximately to the temperature of the combustion zone. The lowest uncorrected junction temperature, $T_{i,min}$, on the other hand, should correspond approximately to the local mean temperature of the preheated air at a region outside of the combustion zone. Since the porous wall serves as a regenerator for the inlet air, the wall temperature must be greater than the lowest uncorrected junction temperature.

We are now in a position to calculate a corrected mixed chamber temperature and its range of variation. For a given run, $T_{i,max}$ and $T_{i,min}$ are utilized to generate the uncertainty about $T_w$. Equation (2) is then utilized to calculate the corrected mixed chamber temperature, $T_c$, which is compared with the model prediction, $T_{p,i}$. The overall uncertainty of $T_c$ is the result of the propagation of all the errors surrounding equation (2).

The interaction of all heat transfer mechanisms, linear and nonlinear, coupled with combustion, periodic transients due to rotation, and fluid dynamics, presents a formidable task to any detailed finite difference formulation, let alone an analytical one. Not only is a differential analysis next to impossible, its results would be dependent on many suspicious assumptions, due to the uncertainty of the parameters. For example, it is difficult to specify the local air leakage and the flame location on a quantitative basis. The design usefulness of such detailed treatment is not warranted.

A model was desired which would allow more time for the design and experimental evaluation of the furnace; which would not require detailed assumptions, yet would supply an ideal upper limit of the furnace performance and be used as a design aid; which would ascertain the relative importance and effect of parameters and operating conditions on performance. For expediency, we wanted a model that could use existing explicit correlations. The model should be able to give clues as to which major assumptions are reasonable or unreasonable.

The major thermal phenomena occurring in the furnace include periodic exchange of heat between air and combustion products (thermal regeneration), combustion in the chamber, and interaction between these. To develop the model, we will assume that these two phenomena can be treated separately and then coupled through energy balances. FIG. 8 presents the energy flow diagram for the furnace. The overall energy balance is given by $$\dot{H}_{fuel}(T_{a,o})+\dot{H}_{air}(T_{a,o})=\dot{H}_{prod}(T_{p,o})+\dot{Q}_{load}+\dot{Q}_{env} \quad (4)$$

where, as shown in the energy flow diagram, $H_{fuel}(T_{a,o})$ and $H_{air}(T_{a,o})$ stand for the enthalpy of the air and fuel flowing into the furnace, respectively. For simplicity, both air and fuel are assumed to be at the initial ambient temperature, $T_{a,o}$. $H_{prod}(T_{p,o})$ stands for the enthalpy of the exhaust, i.e., products of combustion $Q_{load}$ and $Q_{env}$ stand for the heat loss due to external load (cooling water in our case) and the environmental heat loss, respectively.

Assuming a fully mixed, homogeneous and complete combustion, the energy balance for the combustion process can be written as $$\dot{H}_{fuel}(T_{a,o})+\dot{H}_{air}(T_{a,i})=\dot{H}_{prod}(T_{p,i})+\dot{Q}_{load} \quad (5)$$

Note that the enthalpy of air is evaluated at $T_{a,i}$, the temperature inside the furnace which is expected to be higher than $T_{a,o}$ due to thermal regeneration by the porous wall.

Mathematically, the heat regeneration for the inlet air and exhaust flowing through the porous wall can be described by $$\dot{H}_{air}(T_{a,i})-\dot{H}_{air}(T_{a,o})=\dot{H}_{prod}(T_{p,i})-\dot{H}_{prod}(T_{p,o}) \quad (6)$$

where the subscript o and i stand for temperature evaluated outside of and inside of the furnace, respectively. While $T_{a,o}$ is the ambient temperature and $T_{p,i}$ is calculated based on equation (6), $T_{a,i}$ and $T_{p,o}$ are given by the following relations:

$$T_{a,i}=\epsilon(T_{p,i}-T_{a,o})+T_{a,o} \quad (7)$$

$$T_{p,o}=T_{p,i}-\epsilon C^*(T_{p,i}T_{a,o}) \quad (8)$$

with $$C^* = \frac{(\dot{m}c_p)_{min}}{(\dot{m}c_p)_{max}} \quad (9)$$

The regenerator effectiveness, $\epsilon$, is obtained from a set of published numerical data as will be described. $(mc_p)_{min}$ and $(mc_p)_{max}$ stand for the minimum and maximum of the heat capacity rate for the two gas streams (air and exhaust) flowing through the porous bed.

Figure 9:
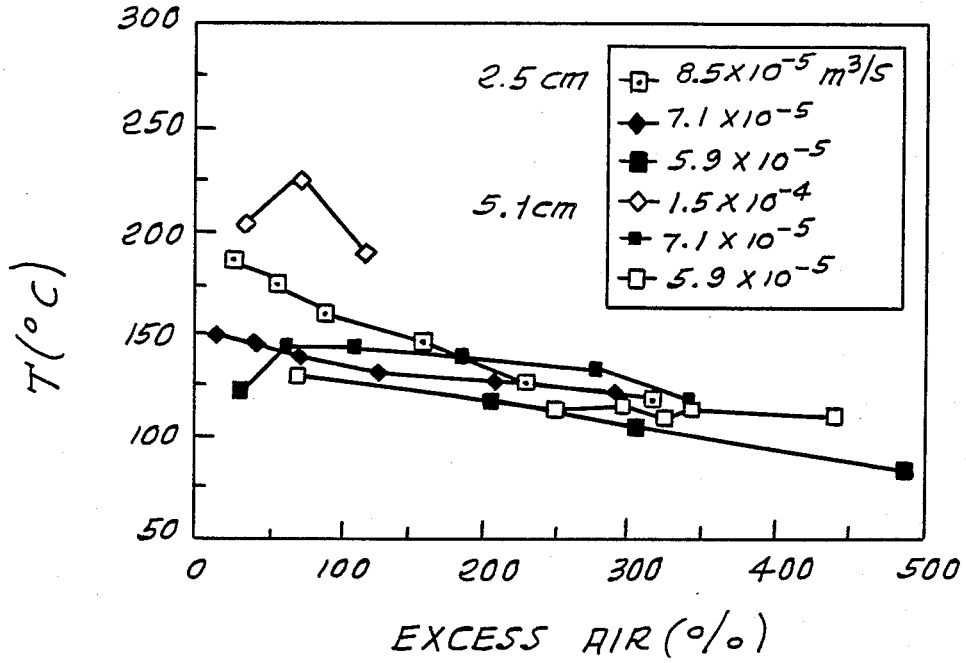
Figure 10:
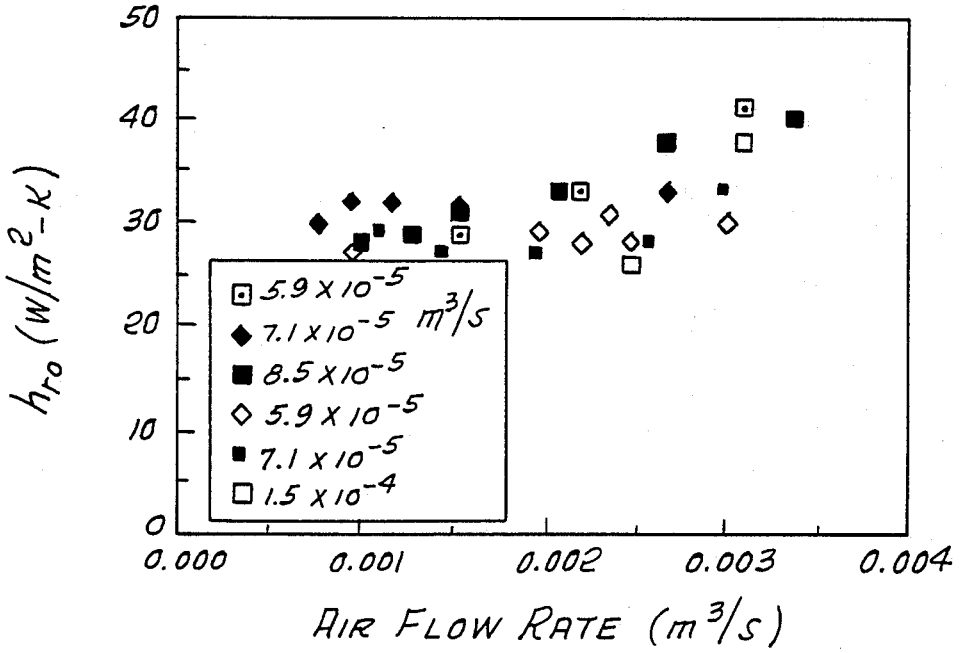

To estimate $Q_{env}$, the heat transfer between the outer surface of the furnace (the rotor) and the environment needs to be evaluated. Since every term in equation (4) can be readily measured except $Q_{env}$, an effective external heat transfer coefficient for the furnace was estimated with the relation $$h_{r0} = \frac{\dot{H}_{fuel}(T_{a,o}) + \dot{H}_{air}(T_{a,o}) - \dot{H}_{prod}(T_{p,o}) - \dot{Q}_{load}}{A_{ro}(T_{ro} - T_{env})} \quad (10)$$

with $A_{ro}$ being the total outer surface area of the rotor. The average external temperature of the furnace, $T_{ro}$, is a weighted average of temperatures taken on the rotor surface at the end of each run at zero RPM. Plots of $T_{ro}$ and of $h_{ro}$ for different fuel flow rates and air flow rates (which lead to different $T_{ro}$) are shown in FIGS. 9 and 10. For the range of fuel flow rate tested, $h_{ro}$, appears to be mainly a function of air flow rate (and of gas flow rate to a much smaller extent). Increases in volumetric air flow rate increase the amount of air leaking around the seals. This in turn raises $h_{ro}$.

Figure 14:
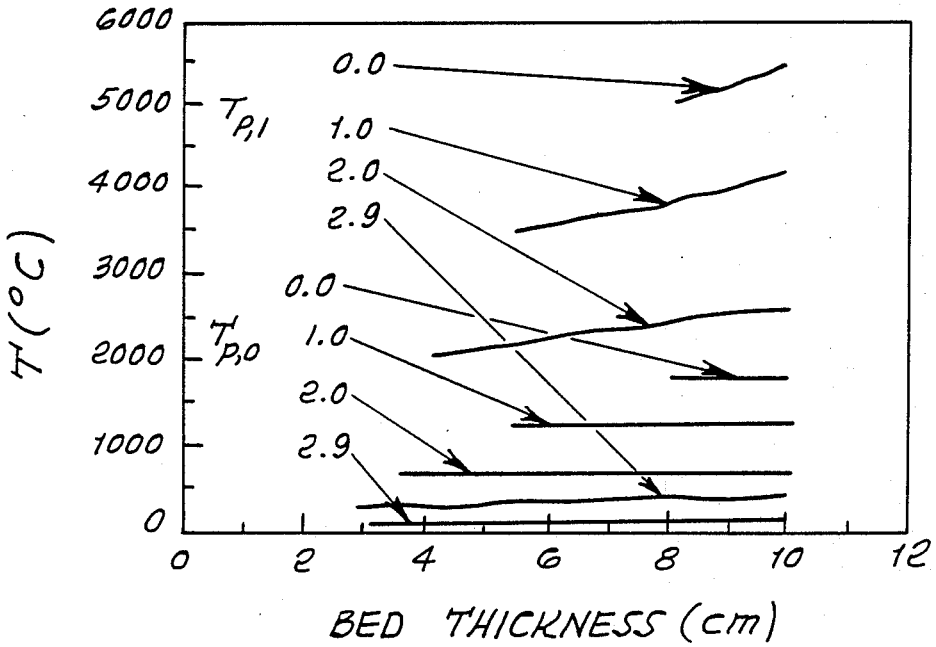
Figure 15:
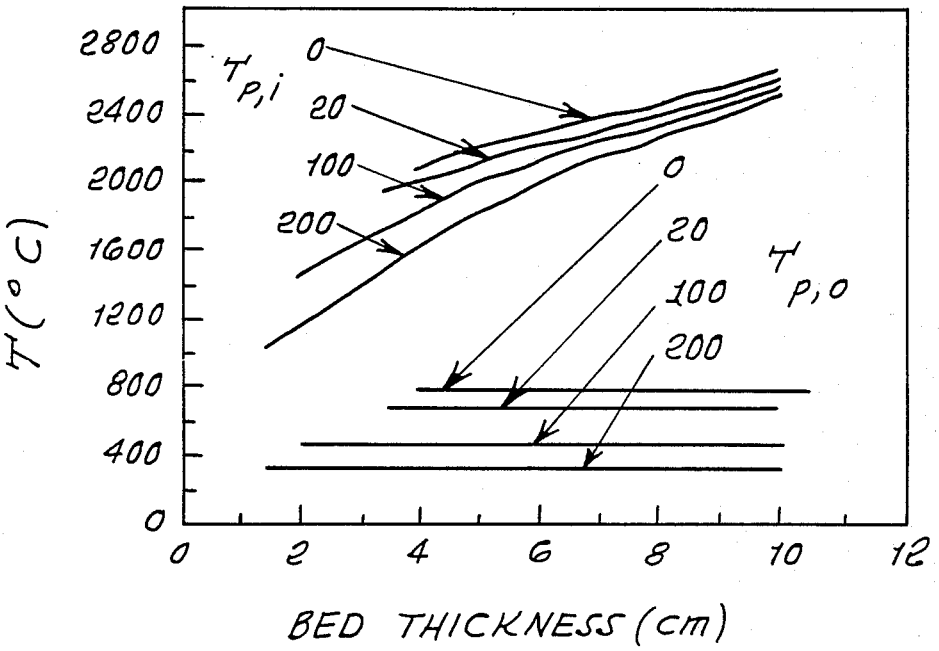
Figure 16A:
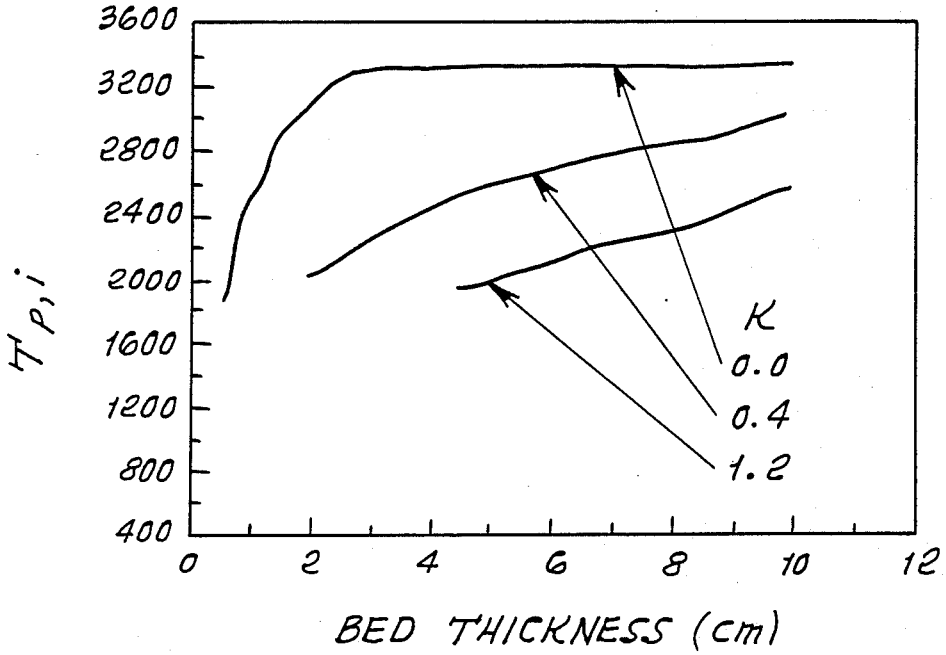
Figure 16B:
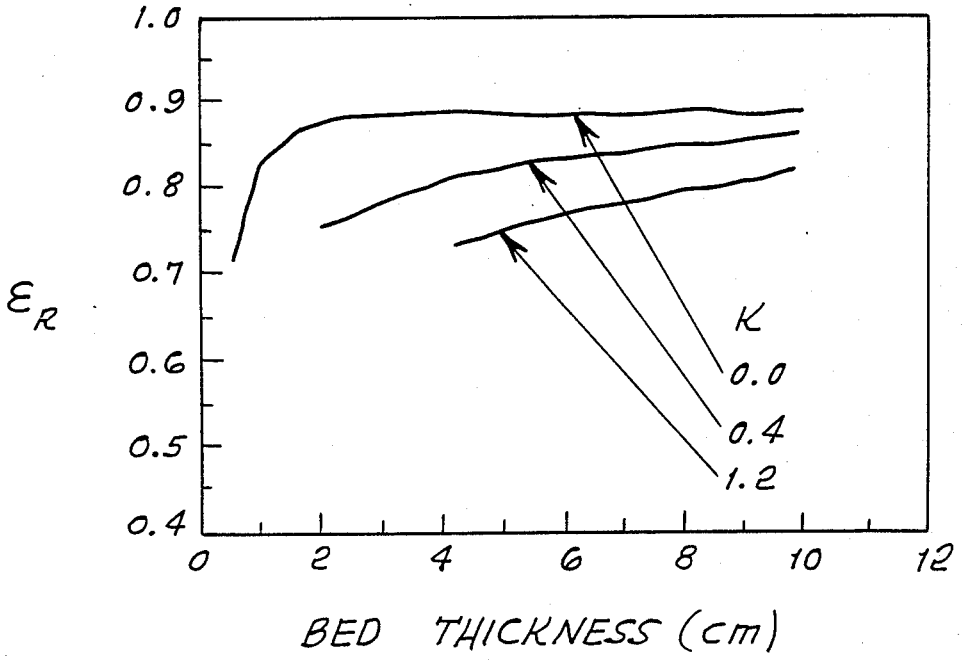
Figure 17:
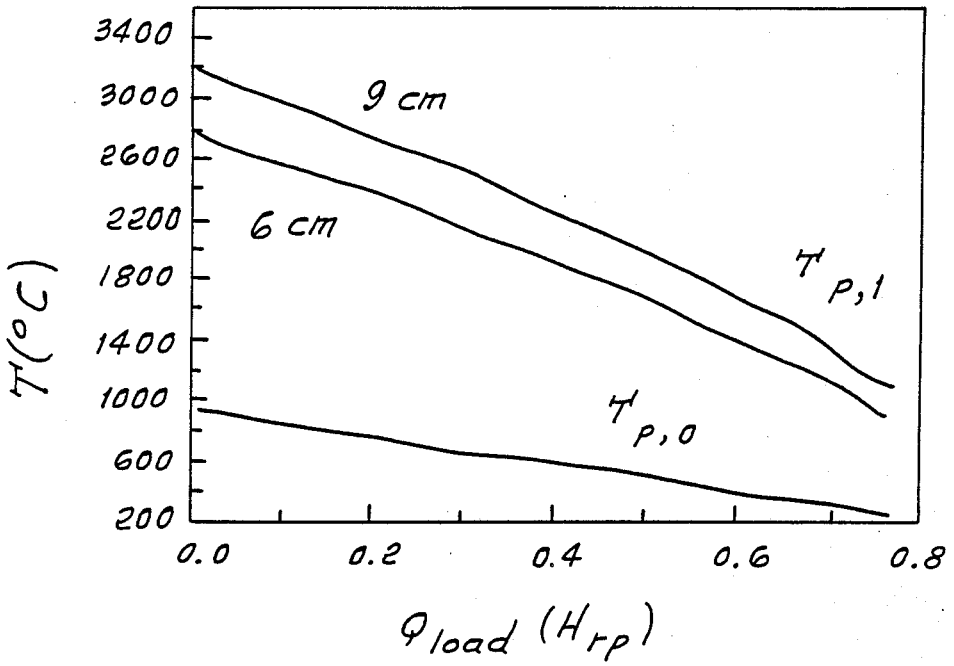

In the model predictions, FIGS. 14–16, $Q_{load}$ and $Q_{env}$ were lumped together as an operating parameter, Q, remaining constant for each displayed curve as to not obscure the impact of other parameters on performance. In FIG. 17 this is not the case. $Q_{load}$ is specified but $Q_{env}$ is made a function of $T_{p,i}$ and $T_{p,o}$.

A porous bed is the fundamental component of the furnace. In the model, we are taking this bed to function simply as a thermal regenerator. Regenerators can be of two types: valved fixed-bed and rotating-bed [8]. A regenerator functions by means of exchanging thermal energy from one fluid stream to another on a periodic basis by removing heat from this fluid during 'hot flow', storing it through its heat capacity and later releasing this heat during 'cold flow' to the fluid to be preheated. The fluids can flow in parallel or in counterflow, even though the latter is more common. After an initial warm-up period, a steady periodic condition is reached. The heat abstracted from one fluid equals that released to the other, and the temperature distributions along the regenerator are repeated periodically.

Over the years, a great deal of work has been reported on the mathematical simulation of an ideal regenerator operation [8–12]. Many of the existing performance correlations, however, are not applicable for the present consideration because they assumed no conduction heat transfer in the direction parallel to fluid flow. Because of the relatively large temperature gradient (1000° C. across 2.5 cm) existing across the porous bed in the furnace, the conduction heat transfer in the radial direction is significant. Numerical data generated by Bahnke and Howard [11], which includes the effect of radial conduction, appears to be the most suitable for the present application. They are used directly in the evaluation of the regenerator effectiveness, $\epsilon$, required by equations (7) thru (9).

When assessing the model's results, it is important to keep in mind the following considerations. The calculation of Bahnke and Howard was made for a one-dimensional flow through an infinite planar porous bed. The curvature of the cylindrical porous bed and the tangential motion induced on the gas by the rotation of the bed are not accounted for by the model. Further, the regenerator, just like in other applications, suffers heat loss to the environment on its outer wall. At the inner wall it is gaining heat directly by convection from the flame. Another phenomena is that of radiation which penetrates into the regenerator and increases the nonlinearity of the temperature distribution in its hot inner side. None of these effects are included in the calculation of Bahnke and Howard.

The theoretical model should thus be used only to analyze the qualitative trend of the data and to provide upper and lower limit on the furnace performance. The comparison of theoretical results with experiments will throw some light on the importance of the phenomena discussed above.

The furnace has run over 150 total hours with the longest set of runs lasting seventeen hours. Bearing and seal wear have been observed to be negligible. Porous bed ceramics suffered some cracking to accommodate thermal expansion and shock, but this did not result in the collapse of the bed. Inspection of the bed surface did not reveal any spalling or major wear.

Figure 3:
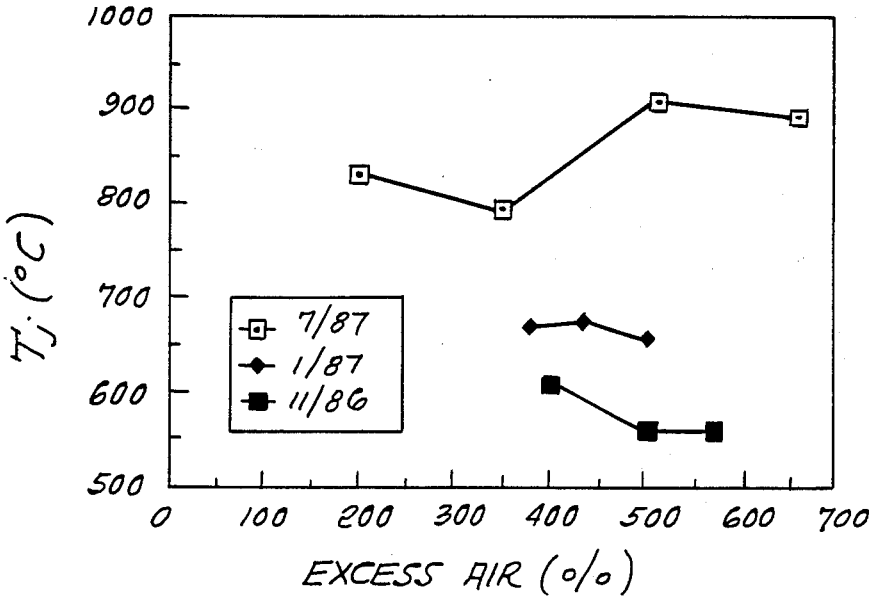
FIGS. 3 and 4 are graphs.
Figure 4:
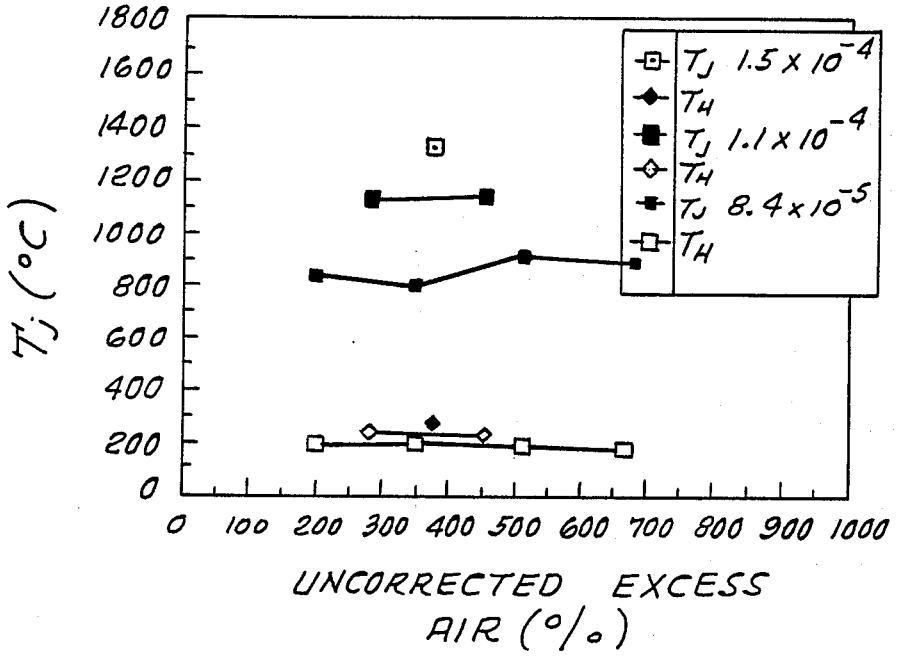

As noted in the previous sections, FIG. 3 represents the improvement in temperature reached during the early development stage. FIG. 4 presents the experimental results for a one inch thick loose zirconia particle bed rotated at 8 RPM and at three gas flow rates. This bed could not be run at higher temperature because it was held together by steel/stainless steel screens which started collapsing due to strong oxidation and weakening of the metal. The bed also offered an inordinate resistance to air flow due to its relatively low porosity and high packing density. Comparison with model prediction is difficult because of the large uncertainty in the actual amount of air entering the furnace and because of other unknowns.

To ease air access to the combustion chamber, a solid porous 2.54 cm thick alumina bed of 83% porosity was installed. In all tests, the furnace rotates at 8 RPM. The total load on the furnace consists of water circulated through the core and heat losses to the environment. They range from 1.2 to 4.2 kw combined. Data for the mixed chamber temperature, $T_c$, and exhaust temperature, $T_x$, for runs with different fuel flow rates and excess air are presented in FIGS. 11A, 11B, and 11C. $T_c$ is presented with error bounds because of the uncertainty in the correction of the junction temperature as discussed.

Figure 11A:
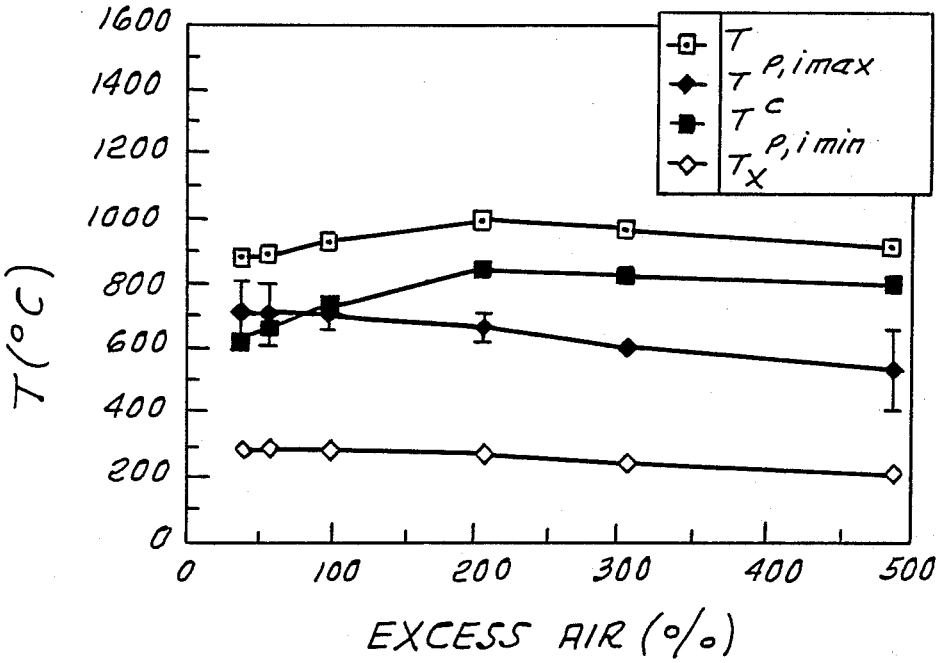
Figure 11B:
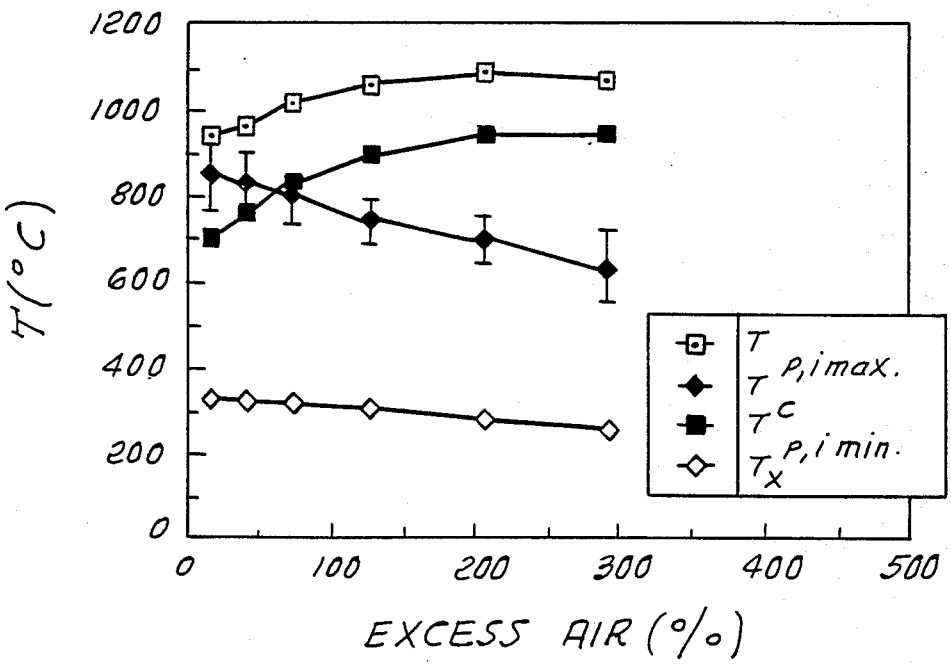
Figure 11C:
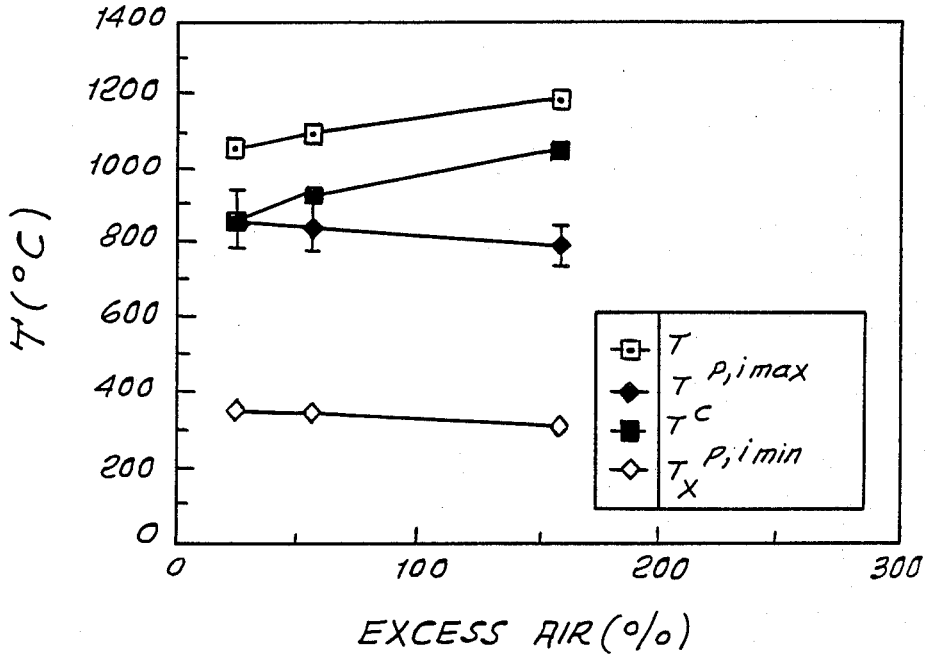
Figure 12A:
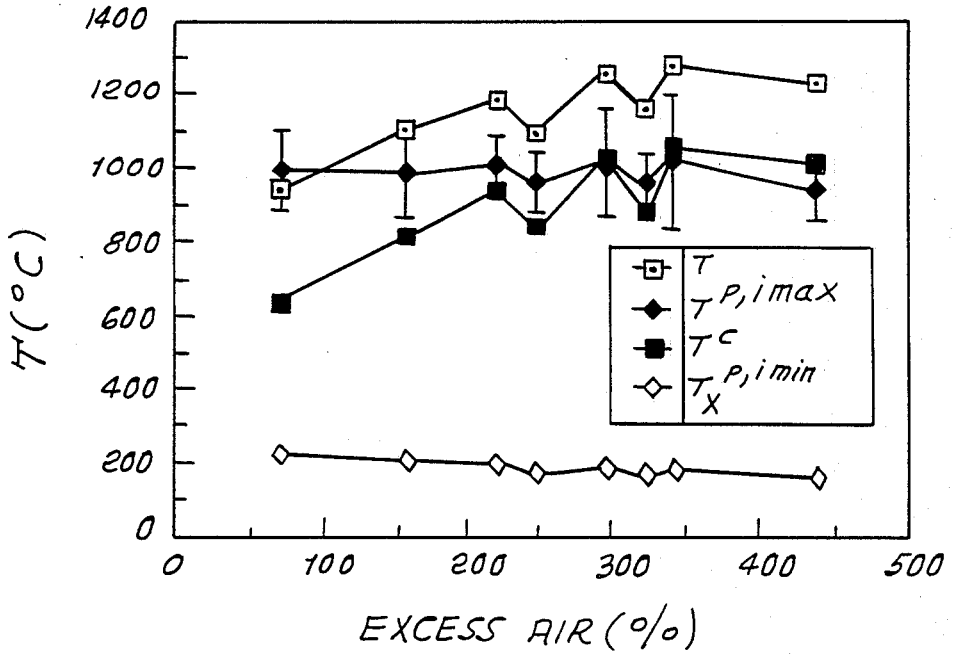
Figure 12B:
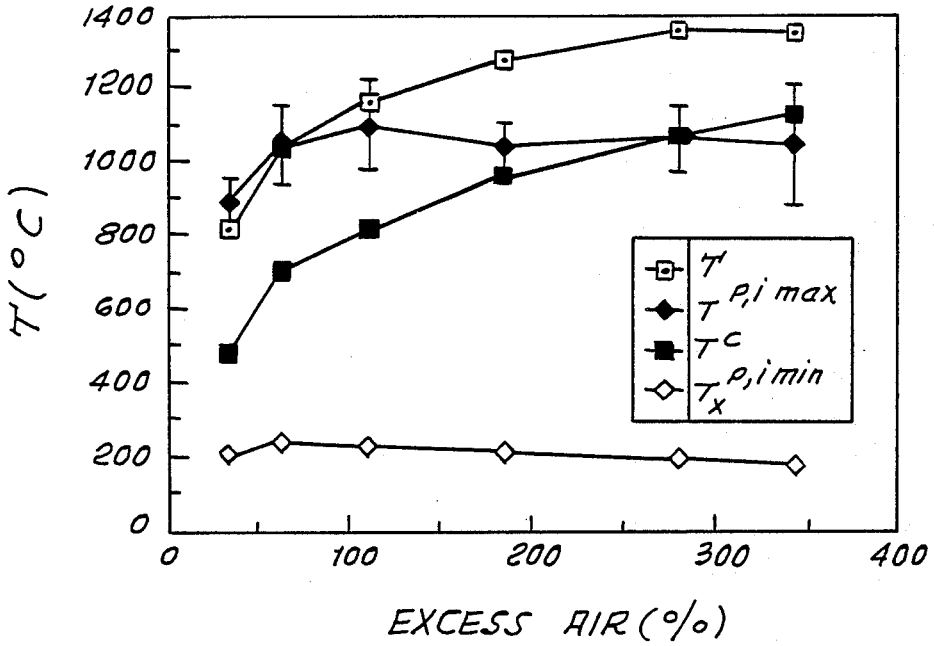
Figure 12C:
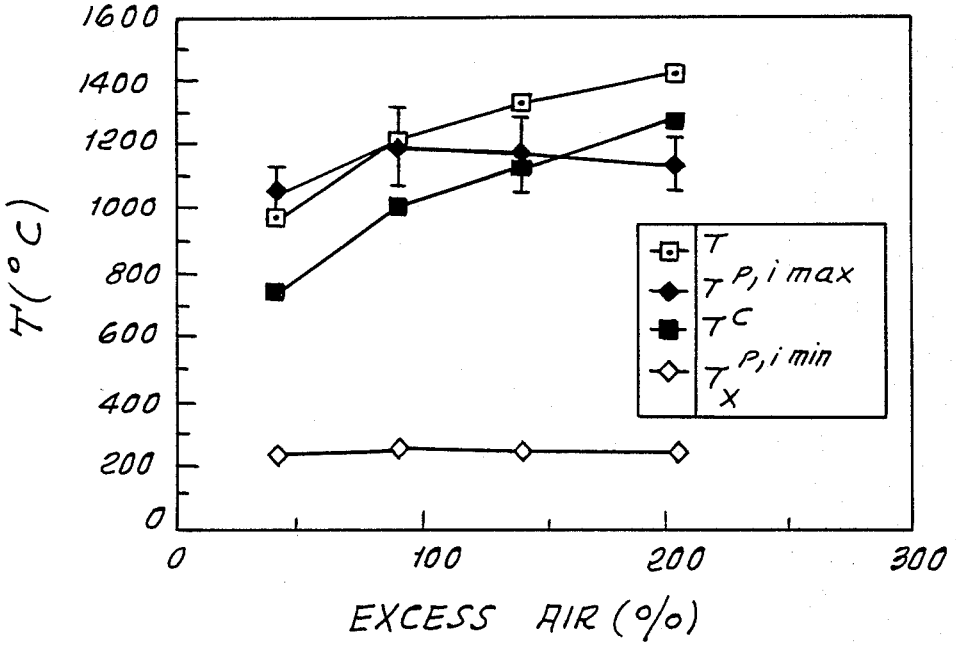
Figure 12D:
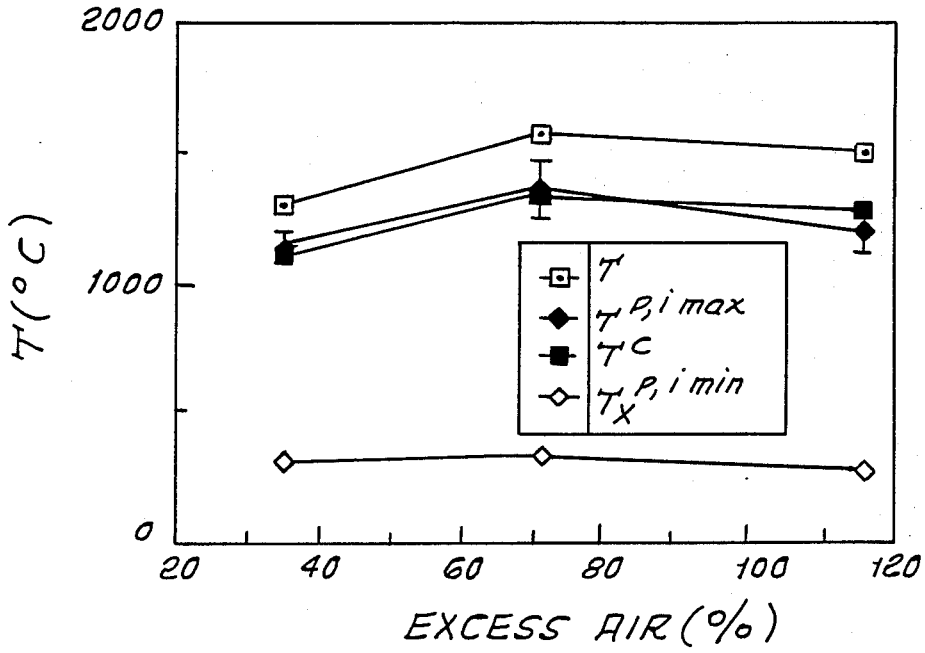

Since the model relies on experimental $Q_{load}$ and $Q_{env}$, its prediction of the mixed chamber temperature, $T_{p,i}$, is also subjected to uncertainty. The upper limit of $T_{p,i}$ is calculated based on the minimum $Q_{load}$ and $Q_{env}$ expected from the furnace while the lower limit of $T_{p,i}$ is calculated based on the corresponding maximum heat transfer The relatively large differences between $T_{p,imin}$ and $T_{p,imax}$ demonstrates readily that the combustion temperature is a sensitive function of the external load and environmental heat loss. FIGS. 11A, 11B, and 11C also indicate that the model is reasonably successful in correlating the quantitative dependence of the mixed chamber temperature on fuel flow rates and excess air. But, it predicts $T_c$ too high. This is not surprising since this particular bed is quite transparent to radiation, reducing regenerator effectiveness and increasing heat loss to the outer rotor surface. The model does not account for these phenomena.

An important and interesting conclusion which can be readily obtained from the limited data presented in FIGS. 11A, 11B, and 11C is that even for a thin porous alumina bed of large pore size, significant thermal regeneration occurs in the furnace. For different fuel flow rates and excess air, the exhaust temperature, $T_x$, stays essentially constant between 200° and 300° C. The mixed chamber temperature, $T_c$, on the other hand, varies between 500° and 900° C. Significant temperature differences (ranging from 200° to 700° C.) are thus maintained across the 2.54 cm thick porous alumina bed.

Results in FIGS. 11A, 11B, and 11C also show that the mixed chamber temperature increases with increasing fuel flow rate. Indeed, additional runs made at higher fuel flow rate suggested that mixed chamber temperatures greater than 1000° C. can be obtained with the same bed. But such runs led to unacceptably high temperatures at the axial seals. Those runs were thus aborted to preserve the integrity of the seals for following experiments.

To achieve higher mixed chamber temperatures, an additional 2.54 cm thick porous zirconia bed of small pore diameter (260 μm) was purchased and installed nesting inside the alumina bed. The selection of small pore diameter (65 ppi) was made as to increase the resistance of the bed to thermal radiation heat transfer. This mode of heat transfer is especially important in the inner layer of the bed due to its high temperature. Experimental results for this composite arrangement are presented in FIGS. 12A, 12B, 12C, and 12D.

Figure 13:
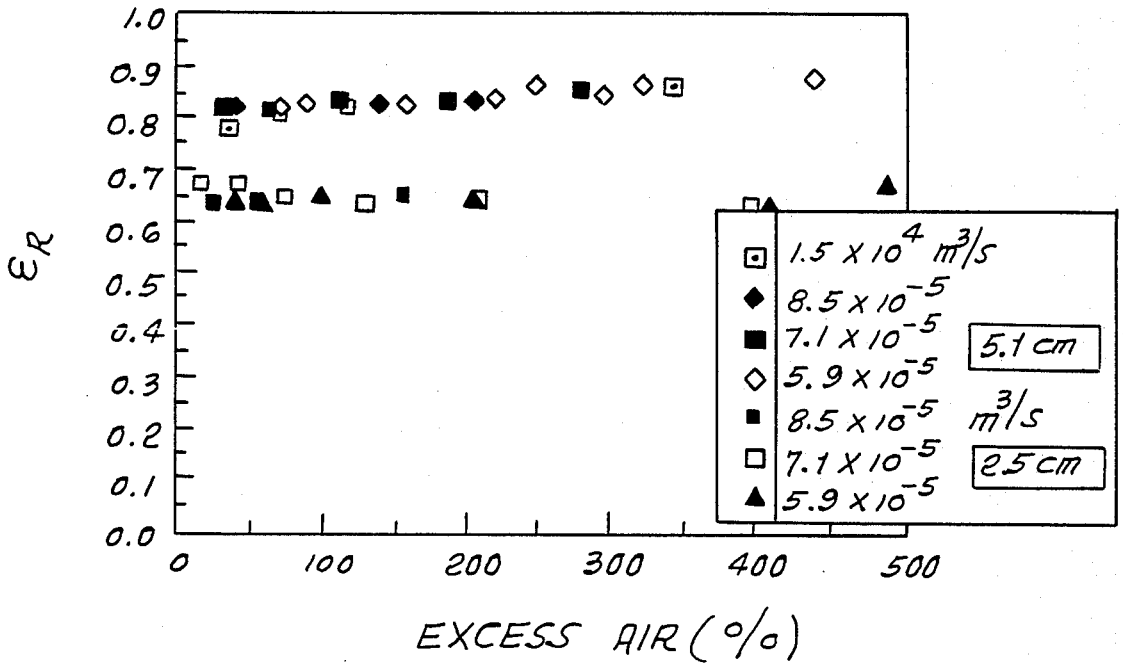

The agreement between model and experiment is much better for this bed than for the previous one. We suspect that the impact of radiation is smaller in this case. FIG. 13 presents the experimentally determined regenerator effectiveness for both beds. A gain of 20% in $\epsilon_R$ is seen to have occurred by adding the second bed. This overall effectiveness, $\epsilon_R$, is defined as $$\epsilon_R = \frac{2}{\frac{1}{\epsilon} + \frac{1}{C^*\epsilon}} \tag{11}$$

The model is utilized to demonstrate the performance characteristics of the furnace over the range of furnace parameters which have not been tested by experiments, and to predict the behavior of the furnace with redesigned seals and rotor drive. Parameters which are expected to influence strongly the combustion chamber temperature include fuel flow rate, excess air, thickness and thermal conductivity of the porous bed, and heat load.

The model results were organized around a baseline operation:

(1) methane flow rate, $V_f = 0.374 \times 10^{-5}$, (3 kw);
(2) excess air, EA = 20%;
(3) heat load, Q = 1 kw;
(4) porosity, $\phi = 0.84$;
(5) specific surface area, $\alpha = 4000\ m^2/m^3$;
(6) zirconia thermal conductivity, [3];
(7) rpm = 1;
(8) $h_{ro} = 10\ w/m^2\text{-}k$.

Results are then generated by varying bed thickness and maintaining all parameters constant except the one under scrutiny for which a set of curves are calculated. One needs to keep in mind the assumptions of the regenerator model, and that no dissociation of the combustion products is taken into account in the combustion equations.

In FIG. 14, the predicted chamber temperature and exhaust temperature for different thermal loads are presented. As expected, the chamber temperature ($T_{p,i}$) increases with increasing bed thickness and decreasing external load heat transfer.

In FIG. 15, the predicted temperatures for various air flow rates is presented. Keeping other parameters the same, the chamber temperature is inversely proportional to excess air and it converges for increasing bed thickness. The latter makes sense considering that the regenerator effectiveness is higher for thicker beds enabling the combustion air to be effectively preheated. Increasing air reduces the temperature of the exhaust temperature though.

Since thermal regeneration is an important effect leading to the high chamber temperature, the thermal conductivity of the porous material is expected to be an important furnace parameter. This is illustrated by FIGS. 16A and 16B. As expected, a porous matrix with low thermal conductivity would lead to efficient thermal regeneration and therefore high chamber temperature. It is interesting to note that the effect of bed thickness diminishes for materials with low thermal conductivity.

FIG. 17 presents the situation for a furnace of two bed thicknesses when subject to increasing thermal loads. The environmental heat loss is also allowed to float, i.e., it is a function of chamber and outer rotor temperatures. This creates a realistic operation condition. It is seen that the chamber temperature is a sensitive function of the load.

Model predictions show that fuel flow rate, excess air, heating load, bed thickness and thermal properties of the porous bed all have important effect on the furnace performance. Chamber temperatures into the 2000° C. seem achievable with small changes in the present design.

Because of the high, controllable chamber temperature and its relative small scale, the furnace can be designed to become an on-site incinerator for various hazardous waste materials. In addition, it also provides a high-temperature thermal radiator (the porous bed inner surface) which can be useful for various industrial processes such as thermophotovoltaic (TPV) conversion, annealing of glass sheets, and sintering of metals and ceramics.

REFERENCES

1. Pelka, D. P., dos Santos, A. M. and Yuen, W. W., "Natural Gas-Fired Thermophotovoltaic System," *Proceeding of the* 32rd International Power Source Symposium, pp. 110–123, June, 1986.
2. dos Santos, A. M., "Design and Experiment of a High-Temperature Gas-Burning Furnace," Ph.D. thesis (in preparation), Department of Mechanical and Environmental Engineering, University of California at Santa Barbara, 1988.
3. Hi-Tech Ceramics, Inc., Alfred, New York.
4. Kent, J. H. and Bilger, G. W., "Measurement Techniques in Turbulent Diffusion Flames, " *First Australian Conference on Heat and Mass Transfer*, Monash University, Melbourne, Section 4.4, 1973, pp. 39.
5. Moffat, R. J., "Gas Temperature Measurement," *Temperature—Its measurement and control in science and industry*, American Institute of Physics, vol. 3, Pt. 2, 1962, p. 557.
6. Beer, J. M. and Chigier, N. A., *Combustion Aerodynamics*, Wiley, 1972, p. 40.
7. Chigier N. A. and Strokin, V., "Mixing Process in a Free Turbulent Diffusion Flame," *Combustion Science and Technology*, vol. 9, 1974, p. 115.
8. Schmidt, F. W. and Willmott, A. J., *Thermal Energy Storage and Regeneration*, McGraw-Hill, 1981.
9. Shah, R. K., "Thermal Design Theory for Regenerators," *Heat Exchanger Designs: Rating, Sizing and Optimization*, Edited by Kakac, Bergles, Moyinger, 1981, pp. 721–763.
10. Kays, W. M. and London, A. L., *Compact Heat Exchanger*, 3rd Ed., McGraw Hill, New York, 1984.
11. Bahnke, G. D. and Howard, C. P., "The Effect of Longitudinal Heat Conduction on Periodic-Flow Heat Exchanger Performance," *Journal of Engineering for Power, TRANS. ASME*, Series A, Vol. 86, April 1964, pp. 105–120.
12. Shah, R. K., "A correlation for longitudinal Heat Conduction Effects in Periodic-Flow Heat Exchangers," *Journal of Engineering for Power, TRANS. ASME*, July, 1975, pp. 453–454.

Nomenclature

A = surface area, ($M^2$)
C* = gas streams' heat capacity ratio, (eqn 9)
EA = excess air
h = convective heat transfer coefficient, ($w/m^2$-k)
$\dot{H}$ = enthalpy rates, (kw)
k = thermal conductivity, (w/m-k)
$\dot{Q} = \dot{Q}_{load} + \dot{Q}_{env}$, (kw)
$\dot{Q}_{env}$ = environmental heat loss, (kw)
$\dot{Q}_{load}$ = useful thermal load, (kw)
T = temperature, (°C.)
$T_i$ = local furnace chamber temperature
$T_j$ = mean uncorrected chamber temperature
$T_w$ = inner chamber wall temperature
$T_{wi}$ = inlet water temperature
$T_{wo}$ = outlet water temperature
$T_x$ = experimental exhaust temperature
$\dot{V}_f$ = fuel flow rate, ($m^3/s$)

Greek Symbols $\alpha$ = porous bed specific heat transfer area, ($m^2/m^3$)
$\epsilon$ = regenerator effectiveness
$\epsilon_R$ = overall regenerator effectiveness, (eqn 11)
$\sigma$ = Boltzman constant, ($5.729 \times 10^{-8} w/m^2\text{-}k^4$)
$\phi$ = porous bed porosity

Subscripts a = air
c = chamber
i = inner porous bed
o = outer porous bed
p = products of combustion
ro = rotor

I claim:

1. Furnace apparatus comprising, in combination:
(a) a rotor, and means to rotate the rotor, the rotor having opposite ends,
(b) a substantially cylindrical, porous ceramic bed carried by the rotor, the bed having an axis of rotation, the bed surrounding and defining an interior combustion zone, and thermal insulation means substantially closing said opposite ends of the rotor, said ends axially spaced apart,
(c) a housing into which the rotor and bed are received, and having an inlet for air to pass sidewardly through the rotating bed via one side thereof to be preheated and then to pass into said interior zone,
(d) fuel inlet means for supplying fuel to said combustion zone to mix with air therein for combustion in said zone,
(e) and the housing having an outlet to discharge hot combustion products which have passed sidewardly through said porous bed via another side thereof to pre-heat same for subsequent rotation into the path of the air to pass therethrough,
(f) the bed thickness predetermined to provide regeneration, at over 1,000° C.

2. The combination of claim 1 wherein the bed consists of non-metallic material.

3. The combination of claim 1 wherein the rotor includes a perforate metallic wall which is cylindrical, the bed carried adjacent the inner side of said perforate wall.

4. The combination of claim 1 wherein the bed consists of at least one of the following:
(i) alumina
(ii) alumina/zirconia composite.

5. The combination of claim 1 including sealing means sealing off between the bed and the interior of the housing, said means providing porting for flow of air into the bed, and for flow of combustion products from the bed, said porting located at opposite sides of said axis.

6. The combination of claim 5 wherein said sealing means includes annular end seals at opposite ends of the cylindrical bed and there being a fuel supply nozzle projecting through one of said bed seals for directing fuel directly into said zone.

7. The combination of claim 1 wherein the rotor comprises a stainless steel shell, containing said thermal insulation means at axially opposite ends of the shell.

8. The combination of claim 1 wherein the bed has effectively between 50% and 90% porosity.

9. The combination of claim 5 wherein said sealing means includes arcuate, synthetic resinous sheets closely fitting the outer side of the rotor, which is cylindrical about the bed.

10. The combination of claim 9 wherein said sheet seals are non-rotary, and consist of Teflon, or the like.

11. The combination of claim 1 including control means controlling rotation of the rotor, air flow into the combustion zone, via the rotating bed, and fuel flow to the combustion zone.

12. The combination of claim 1 including a temperature sensor projecting axially into said zone.

* * * * *